US011051608B1

(12) United States Patent
Zhu

(10) Patent No.: US 11,051,608 B1
(45) Date of Patent: Jul. 6, 2021

(54) BOLT GREASE REMOVAL DEVICE

(71) Applicant: Gong Zhu, Xiamen (CN)

(72) Inventor: Gong Zhu, Xiamen (CN)

( * ) Notice: Subject to any disclaimer, the term of this patent is extended or adjusted under 35 U.S.C. 154(b) by 0 days.

(21) Appl. No.: 17/086,480

(22) Filed: Nov. 2, 2020

(30) Foreign Application Priority Data

Mar. 23, 2020 (CN) ..... 202010208666.1

(51) Int. Cl.

| | |
|---|---|
| ***A46B 13/04*** | (2006.01) |
| ***B08B 1/04*** | (2006.01) |
| ***A46B 13/02*** | (2006.01) |
| ***B08B 1/02*** | (2006.01) |
| ***B08B 1/00*** | (2006.01) |
| ***B08B 3/08*** | (2006.01) |
| ***A46B 13/00*** | (2006.01) |
| ***B08B 7/04*** | (2006.01) |

(52) U.S. Cl.

CPC ..... *A46B 13/04* (2013.01); *A46B 13/001* (2013.01); *A46B 13/02* (2013.01); *B08B 1/002* (2013.01); *B08B 1/007* (2013.01); *B08B 1/008* (2013.01); *B08B 1/02* (2013.01); *B08B 1/04* (2013.01); *B08B 3/08* (2013.01); *B08B 7/04* (2013.01); *A46B 2200/3073* (2013.01)

(58) Field of Classification Search

CPC . A46B 13/02; A46B 13/04; A46B 2200/3086; A46B 2200/3093; A46B 130/02; A46B 130/04; B08B 1/007; B08B 1/008; B08B 1/02; B08B 1/04

USPC ..... 15/21.1, 88

See application file for complete search history.

(56) References Cited

U.S. PATENT DOCUMENTS

| | | | | |
|---|---|---|---|---|
| 2,658,466 A * | 11/1953 | Hall | B23K 3/08 228/23 |
| 3,263,255 A * | 8/1966 | Stevens | A63D 5/10 15/21.1 |
| 2007/0167114 A1* | 7/2007 | Fromel | B24B 9/00 451/11 |

* cited by examiner

*Primary Examiner* — Mark Spisich

(57) ABSTRACT

A device has a rectangular box, a roller driving unit and a controller are arranged to a side surface of the rectangular box, a grease removal unit is arranged to an inner surface of the rectangular box. The bolt grease removal device drives a conveyor belt to rotate through an electric motor, swing levers of clamping components play a role in fixing bolts, rotation of the conveyor belt drives bolts to make a circular motion to move bolts to a position of a cleaning brush to achieve an effect of removing grease on outer surface of bolt. Different rollers drive different cleaning brushes to rotate, use different sizes of driven wheels to make cleaning brushes have a certain relative speed to achieve an effect of rotating bolts and to increase the contact surface.

8 Claims, 14 Drawing Sheets

BOLT GREASE REMOVAL DEVICE

CROSS-REFERENCE TO RELATED APPLICATIONS

This application claims priority benefit of Chinese Patent Application No. 202010208666.1 filed on 23 Mar. 2020. The above-referenced application is hereby incorporated herein by reference.

BACKGROUND OF THE INVENTION

The invention relates to bolt cleaning devices, especially to bolt grease removal devices.

There is a phenomenon of replacement of new and old metal products during use, a large amount of scrap metal may be produced every year due to corrosion, damage and natural elimination of metal products. Among them, there may be a large number of bolts scattered on the ground in production process of factory, these bolts can be reused after recycling. Patent application number 2018219075041 discloses a productive scrap metal recycling device, a second electromagnet and a third electromagnet are arranged on a top surface of a screening box in direction of a conveying mechanism, and a magnetic force generated by the second electromagnet after being energized is smaller than a magnetic force generated by the third electromagnet. When bolts of different types move on a conveyor belt, they are attracted by a downward gravity and a upward force from the second or third electromagnet. Although the patent can simply classify bolts through action of electromagnetic force adsorption or release, grease attached to outer surface of bolt has a greater impact on later recovery process, and it cannot effectively remove grease on outer surface of bolt.

BRIEF SUMMARY OF THE INVENTION

The present invention aims to provide a bolt grease removal device, it has function of removing grease on outer surface of bolt to solve a problem that grease on outer surface of bolt cannot be removed. Bolts are rotated and cleaned by cleaning brushes, so that dirt and grease on outer surface of bolt are removed, bolts can be cleaned comprehensively by using cleaning brushes with different rotation speeds.

Such object is achieved by providing a bolt grease removal device as defined in claim 1, further advantageous according to the invention will be apparent from the dependent claims.

The present invention provides a bolt grease removal device, the device comprises a rectangular box, a roller driving unit and a controller are arranged to a side surface of the rectangular box, a grease removal unit is arranged to an inner surface of the rectangular box. A grease collection unit is arranged to a lower end of an inner surface of the rectangular box, the grease removal unit comprises a T-shaped opening arranged on a side surface of the rectangular box, two T-shaped openings are arranged in a parallel state, upper and lower ends of the T-shaped opening are provided with a first bearing, the first bearing is fixedly connected with the rectangular box. An inner surface of the first bearing is provided with a rotating roller, the rotating roller is connected to the first bearing by plug-in connection. A conveyor belt is installed on an outer surface of the rotating roller, both ends of the conveyor belt are sleeved with the rotating roller, a lower end of a side surface of the conveyor belt is provided with a first rack, the first rack is fixedly connected to the conveyor belt. A first electric motor is installed on a side surface of the rectangular box, a first gear that meshes with the first rack is provided on a rotating end of the first electric motor.

An installation box is installed on an outer surface of the conveyor belt, the installation box is fixedly connected to the conveyor belt. A second opening is arranged on one side of the installation box. A clockwork spring is installed on an inner surface of the installation box, an outer ring of the clockwork spring is fixedly connected with the installation box, an inner ring of the clockwork spring is provided with a rotating disc, the rotating disc is plugged in and connected with the clockwork spring. A side surface of the rotating disc is provided with a swing lever, two swing levers are provided, one end of each swing lever is plug-in connected with the rotating disc. An extension spring is installed between the swing levers, the extension spring is fixedly connected to the swing levers, one end of the swing lever is provided with a rectangular groove.

A first roller is installed on an opposite side surface of an upper end of the rectangular box, the first roller is connected to the rectangular box by plug-in connection, a first driven wheel is installed at one end of the first roller, a second roller is installed on an opposite side surface of a lower end of the rectangular box, the second roller is connected to the rectangular box by plug-in connection, a second driven wheel is installed at one end of the second roller, each outer surface of the first roller and the second roller is provided with a cleaning belt, both ends of the cleaning belt are respectively sleeved with the first roller and the second roller, a cleaning brush is arranged on an outer surface of the cleaning belt, the cleaning brush is fixedly connected with the cleaning belt.

Advantageous Effects

1. The bolt grease removal device drives a conveyor belt to rotate through an electric motor, swing levers of clamping components play a role in fixing bolts, rotation of the conveyor belt drives bolts to make a circular motion to move bolts to a position of a cleaning brush to achieve an effect of removing grease on outer surface of bolt.

2. Different rollers drive different cleaning brushes to rotate, use different sizes of driven wheels to make cleaning brushes have a certain relative speed to achieve an effect of rotating bolts and to increase the contact surface.

3. Cleaning brushes both of a first cleaning brush group and a second cleaning brush group are alternately arranged to increase number of cleaning brushes within a certain distance, it is helpful to improve cleaning effect of outer surface of bolt. Through such alternate arrangement of the first cleaning brush group and the second cleaning brush group, brush rings of adjacent cleaning brushes are also alternately arranged, outer surface of bolt is cleaned by brush bars with different rotation directions, this is beneficial to improve cleaning effect of outer surface of bolt.

4. By detachably connecting a second rod and a third rod of the cleaning brush, only a third rod needs to be replaced after brush bars of the cleaning brush are worn out, and the entire cleaning brush does not need to be replaced. By detachably connecting the second rod and a second gear, only the second gear needs to be replaced after the second gear is worn, without need to replace the entire cleaning brush.

5. First pre-tension a clockwork spring and then insert a second shaft of a rotating disc into a first slideway, the second shaft is pulled into a second slideway and stays in the second slideway under elastic force from the clockwork spring, a bolt rotates back to original position under elastic force from the clockwork spring after the bolt is rotated slightly by force from cleaning brush, the bolt has a certain degree of toughness during rotation process, thereby increasing cleaning area of outer surface of bolt.

6. A rectangular baffle filters grease on outer surface of cleaning brush on outer surface of the baffle, a nozzle sprays liquid used to decompose the grease to quickly decompose the grease and achieve an effect of removing grease.

BRIEF DESCRIPTION OF THE SEVERAL VIEWS OF THE DRAWINGS

Further characteristics and advantages of the invention will emerge from the description of preferred, but not exclusive embodiments of a bolt grease removal device according to the invention, non-limiting examples of which are provided in the attached drawings, in which.

List of reference numbers

| | |
|---|---|
| 1. rectangular box; | 2. controller; |
| 3. T-shaped opening; | 4. first bearing; |
| 5. rotating roller; | 6. conveyor belt; |
| 7. first rack; | 8. first electric motor; |
| 9. first gear; | 10. installation box; |
| 11. second opening; | 12. clockwork spring; |
| 13. rotating disc; | 14. swing lever; |
| 15. extension spring; | 16. rectangular groove; |
| 17. first roller; | 18. first driven wheel; |
| 19. second roller; | 20. second driven wheel; |
| 21. cleaning belt; | 22. cleaning brush; |
| 23. first opening; | 24. sliding groove; |
| 25. collection box; | 26. rectangular baffle; |
| 27. strip opening; | 28. cleaning liquid tank; |
| 29. suction pump; | 30. high-pressure nozzle; |
| 31. connecting pipe; | 32. second electric motor; |

-continued

List of reference numbers

| | |
|---|---|
| 33. pulley; | 34. first V-belt; |
| 35. second V-belt; | 36. observation window; |
| 37. non-slip base; | 38. rectangular handrail; |
| 39. maintenance port; | 40. squeeze roller; |
| 41. third opening; | 42. clamping component; |
| 43. second rack; | 44. third rack; |
| 101. first seat; | 102. first rod; |
| 103. first slideway; | 104. second slideway; |
| 105. blind hole; | 121. first end; |
| 122. second end; | 131. first arm; |
| 132. second arm; | 133. first shaft; |
| 134. second shaft; | 141. first swing lever; |
| 142. second swing lever; | 143. first pin; |
| 144. second pin; | 145. third pin; |
| 146. fourth pin; | 147. first retaining ring; |
| 148. second retaining ring; | 161. first rectangular groove; |
| 162. second rectangular groove; | 163. first half hole; |
| 164. second half hole; | 211. first cleaning belt; |
| 212. second cleaning belt; | 229. first cleaning brush group; |
| 220. second cleaning brush group; | 221. second seat; |
| 222. second rod; | 223. second gear; |
| 224. third rod; | 225. brush ring; |
| 226. lower board; | 227. first screw; |
| 228. second screw; | 2211. pit; |
| 2221. disc; | 0. bolt. |

DETAILED DESCRIPTION OF THE INVENTION

Embodiment 1

The present invention will be described in detail below with reference to drawings, as shown in FIGS. 1-4.

In this embodiment, model of a controller 2 is 80051, a signal output end of the controller 2 is electrically connected to signal input ends of a first electric motor 8, a second electric motor 32, and a suction pump 29, a power output terminal of the controller 2 is electrically connected to power input terminals of the first electric motor 8, the second electric motor 32 and the suction pump 29.

Figure 1:
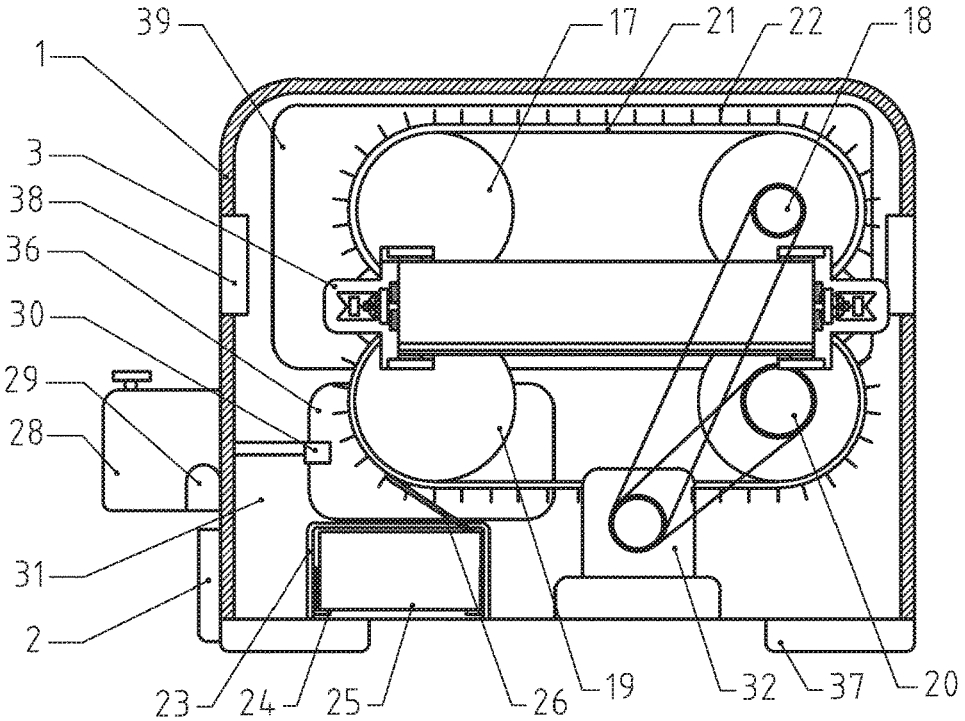
FIG. 1 is a structure schematic drawing of a bolt grease removal device disclosed in embodiment one.
Figure 2:
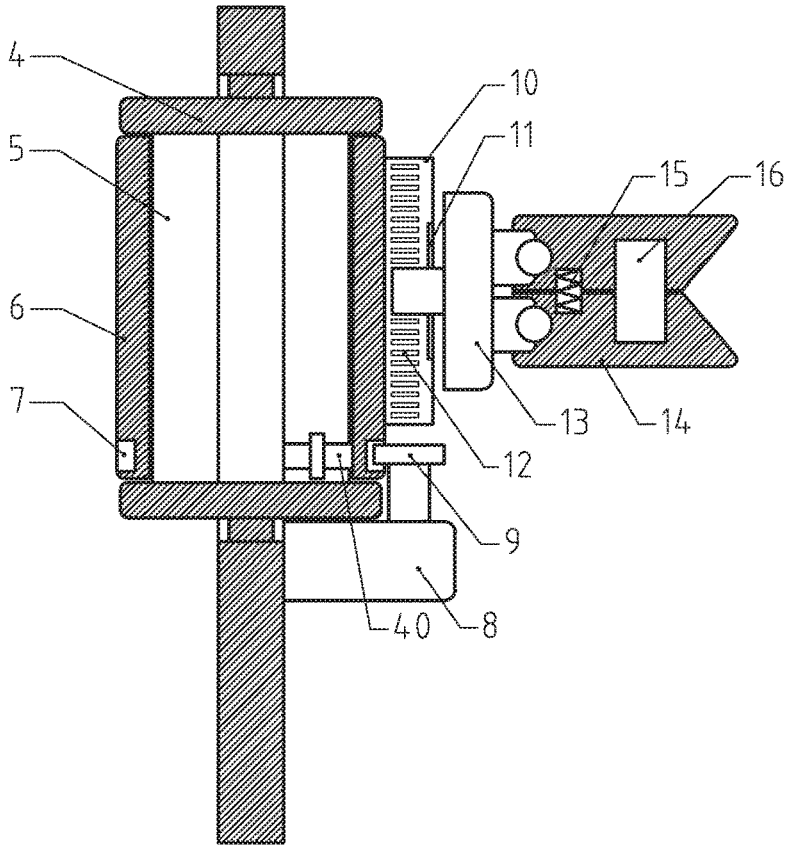
FIG. 2 is a sectional drawing of a bolt grease removal device disclosed in embodiment one.
Figure 3:
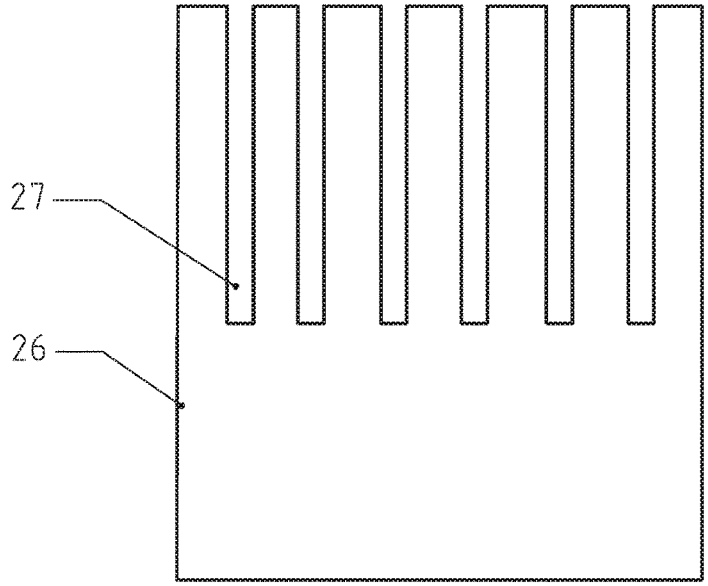
FIG. 3 is a schematic drawing of a rectangular baffle disclosed in embodiment one.

Creative point of the present invention includes structural design of bolt grease removal unit, referring to FIG. 1 and FIG. 2, the bolt grease removal unit drives a conveyor belt 6 to move by a first electric motor 8 so that bolts located outside a rectangular box 1 enter inside of the rectangular box 1, cleaning brushes 22 rotate while bolts move so as to achieve purpose of cleaning outer surface of the bolt. The bolt grease removal unit comprises a T-shaped opening 3, two T-shaped openings 3 are arranged in a parallel state, upper and lower ends of the T-shaped opening 3 are provided with a first bearing 4, the first bearing 4 is fixedly connected with the rectangular box 1. An inner surface of the first bearing 4 is provided with a rotating roller 5, the rotating roller 5 is connected to the first bearing 4 by plug-in connection. A conveyor belt 6 is installed on an outer surface of the rotating roller 5, both ends of the conveyor belt 6 are sleeved with the rotating roller 5. A lower end of a side surface of the conveyor belt 6 is provided with a first rack 7, the first rack 7 is fixedly connected to the conveyor belt 6. A first electric motor 8 is installed on a side surface of the rectangular box 1, a first gear 9 that meshes with the first rack 7 is provided on a rotating end of the first electric motor 8. An installation box 10 is installed on an outer surface of the conveyor belt 6, the installation box 10 is fixedly connected to the conveyor belt 6, a second opening 11 is arranged on one side of the installation box 10. A clockwork spring 12 is installed on an inner surface of the installation box 10, an outer ring of the clockwork spring 12 is fixedly connected with the installation box 10, an inner ring of the clockwork spring 12 is provided with a rotating disc 13, the rotating disc 13 is plugged in and connected with the clockwork spring 12. A side surface of the rotating disc 13 is provided with a swing lever 14, two swing levers 14 are provided, one end of each swing lever 14 is plug-in connected with the rotating disc 13. An extension spring 15 is installed between the swing levers 14, the extension spring 15 is fixedly connected to the swing lever 14, one end of the swing lever 14 is provided with a rectangular groove 16. A first roller 17 is installed on an opposite side surface of an upper end of the rectangular box 1, the first roller 17 is connected to the rectangular box 1 by plug-in connection, a first driven wheel 18 is installed at one end of the first roller 17. A second roller 19 is installed on an opposite side surface of a lower end of the rectangular box 1, the second roller 19 is connected to the rectangular box 1 by plug-in connection, a second driven wheel 20 is installed at one end of the second roller 19. Each outer surface of the first roller 17 and the second roller 19 is provided with a cleaning belt 21, both ends of the cleaning belt 21 are respectively sleeved with the first roller 17 and the second roller 19. A cleaning brush 22 is arranged on an outer surface of the cleaning belt 21, the cleaning brush 22 is fixedly connected with the cleaning belt 21. Such arrangement solves the problem that grease on outer surface of bolt cannot be effectively removed.

Creative point of the present invention also includes structural design of grease collection unit, referring to FIG. 1, the grease collection unit uses a cross action of a rectangular baffle 26 and the cleaning brush 22 to make grease adhere to outer surface of the rectangular baffle 26, then cleaning liquid decomposes grease through an action of a suction pump 29, finally grease falls into a collection box 25. The grease removal unit comprises a first opening 23 provided on a side surface of the rectangular box 1, the first opening 23 is located under the cleaning belt 21. A sliding groove 24 is installed on one side of the first opening 23, the sliding groove 24 is fixedly connected with the rectangular box 1. An inner surface of the sliding groove 24 is provided with a collection box 25, the collection box 25 is slidably connected with the sliding groove 24. A rectangular baffle 26 is installed on an upper end of a side surface of the collection box 25, a lower end of the rectangular baffle 26 is fixedly connected with the collection box 25. A strip opening 27 is provided at an upper end of the rectangular baffle 26, the strip opening 27 corresponds to a position of the cleaning brush 22. A cleaning liquid tank 28 is installed on a side surface of the rectangular box 1, the cleaning liquid tank 28 is fixedly connected with the rectangular box 1. A suction pump 29 is installed on a lower surface of the cleaning liquid tank 28. A high-pressure nozzle 30 is installed on the side surface of the rectangular box 1, a connecting pipe 31 is installed between the high-pressure nozzle 30 and the suction pump 29. Such arrangement solves the problem that grease is not easy to detach due to its adhesion.

Figure 4:
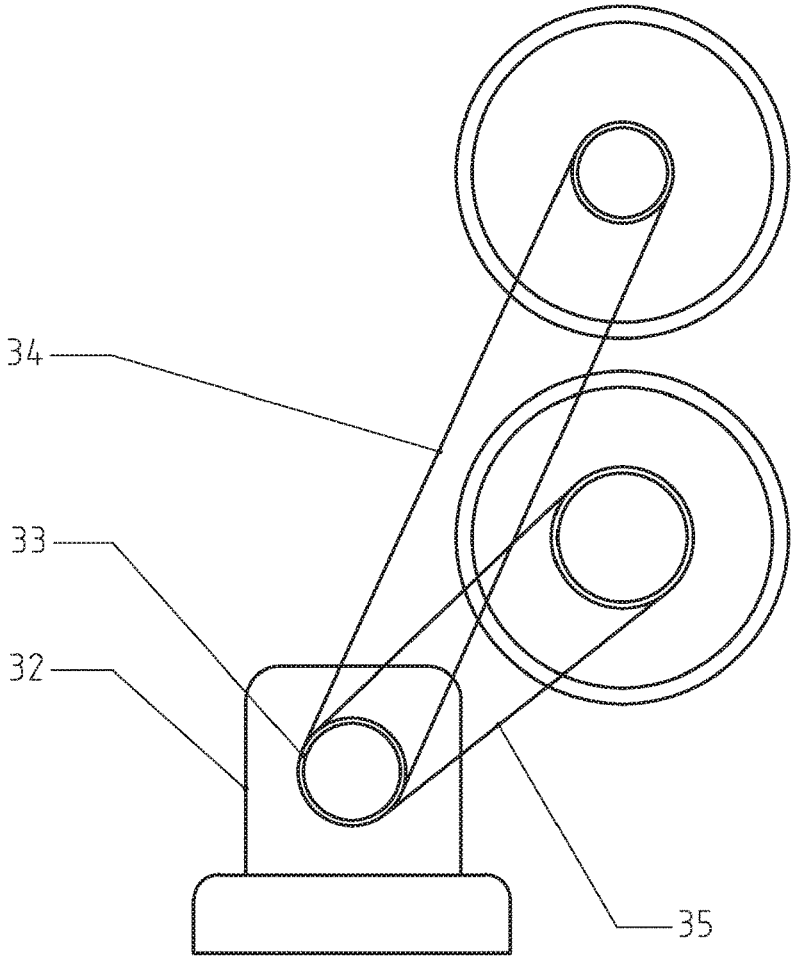
FIG. 4 is a schematic drawing of a roller driving unit disclosed in embodiment one.

Creative point of the present invention also includes structural design of roller driving unit, referring to FIG. 4, the roller driving unit drives the first driven wheel 18 and the second driven wheel 20 which have different diameters with each other by the second electric motor 32 to make their rotation speed different so as to achieve an effect of rotating bolt and increasing contact surface. Such arrangement solves the problem that contact area between bolt and cleaning brush 22 is small.

During operation of the device, the controller 2 controls the first electric motor 8 to rotate intermittently, rotation of the first electric motor 8 directly drives the first rack 7 and the conveyor belt 6 to move through gear meshing, movement of the conveyor belt 6 directly drives the installation box 10 to move, movement of the installation box 10 drives the rotating disc 13 and the swing lever 14 to make a circular motion, when the installation box 10 moves out of the rectangular box 1, manually press bolt head into the rectangular groove 16. Utilizing structural characteristics of the swing lever 14 to make bolt more easily fit into the rectangular groove 16, then the bolt is fixed between the swing lever 14 by elastic action of the extension spring 15, finally the bolt is driven into the rectangular box 1 with movement of the conveyor belt 6.

Meanwhile, the controller 2 controls the second electric motor 32 to rotate, rotation of the second electric motor 32 directly drives the pulley 33 to rotate, rotation of the pulley 33 directly drives the first V-belt 34 and the second V-belt 35 for transmission. Since diameters of the first driven wheel 18 and the second driven wheel 20 are different, rotation speeds of the cleaning belt 21 and the cleaning brush 22 have a certain difference. When a threaded end of bolt moves to an area between the cleaning brushes 22, different speeds of the cleaning brushes 22 make the bolt rotate slightly, elastic action of the clockwork spring 12 makes the rotation of bolt have a certain toughness, thereby increasing area of outer surface of bolt to be cleaned.

While the bolt is moving, the cleaning brush 22 repeatedly cleans thread portions so that grease is removed by the cleaning brush 22, most of grease adheres to outer surface of the cleaning brush 22, When the cleaning brush 22 moves to a place where it interfaces with the rectangular baffle 26, grease is filtered on a lower surface of the rectangular baffle 26 through filtering effect of the rectangular baffle 26. Meanwhile, the controller 2 controls the suction pump 29 to work, operation of the suction pump 29 causes the oil-decomposing liquid to be sprayed on oily surface through the connecting pipe 31 and the high-pressure spray nozzle 30, grease is quickly broken down and falls into the collection box 25.

The squeeze roller 40 can prevent the first electric motor 8 from slipping during transmission process. Through the observation window 36, cleaning state of grease can be visually observed to facilitate adjustment of the device. The collection box 25 can be easily taken out through the sliding groove 24.

Embodiment 2

Figure 5:
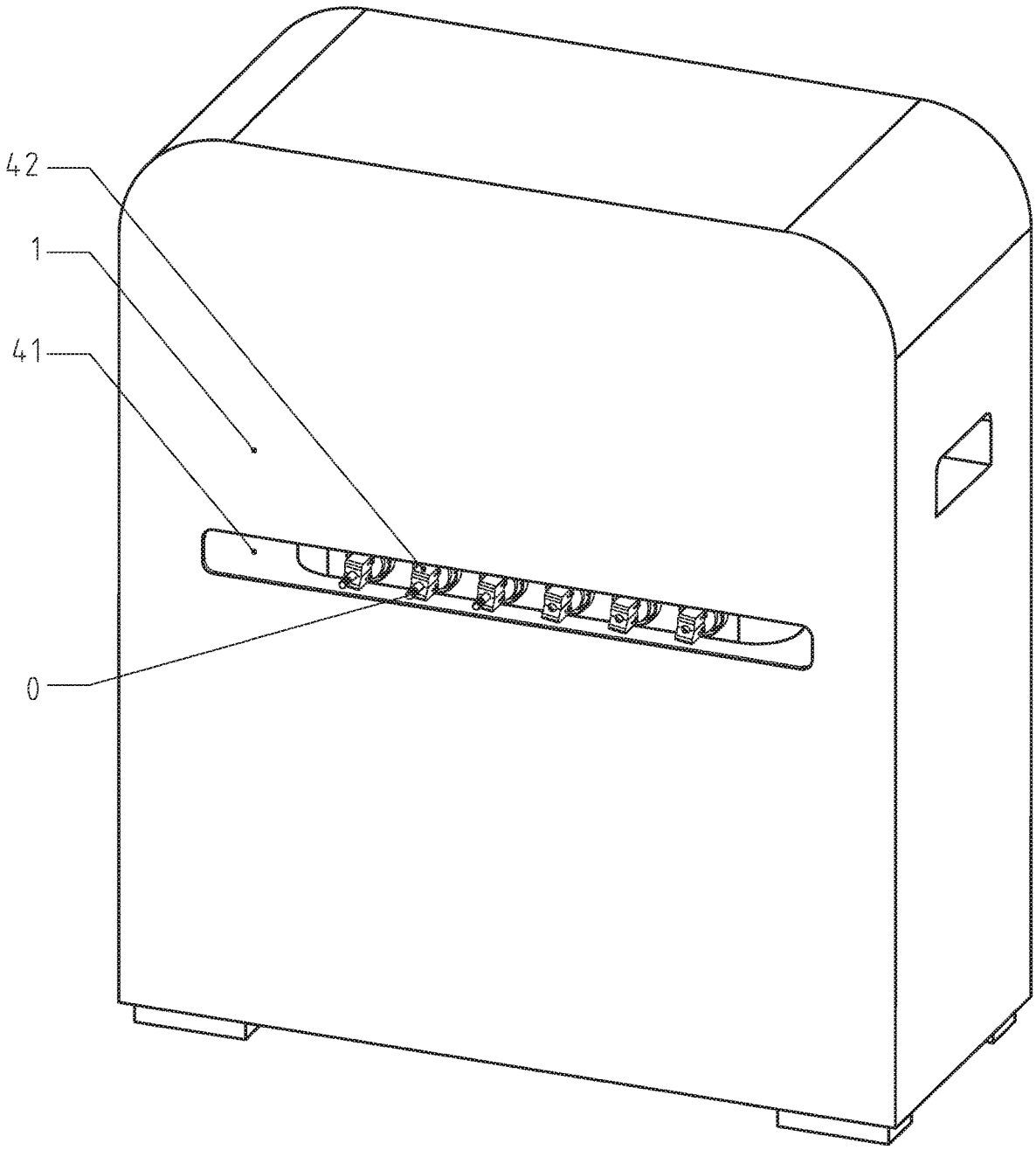
FIG. 5 is a 3d-drawing of a bolt grease removal device disclosed in embodiment two.

FIG. 5 shows a bolt grease removal device disclosed in this embodiment, a third opening 41 is provided on a front side of a rectangular box 1, and the third opening 41 exposes a clamping component 42 for clamping bolts. An operator places a bolt 0 to the clamping component 42 through the third opening 41, three clamping components 42 on left in FIG. 5 have clamped bolts 0, another three clamping components 42 on right in FIG. 5 have not clamped bolts 0 yet. The clamping component 42 uses movement of a conveyor belt 6 to bring bolts 0 into the rectangular box 1 for grease removal.

Figure 6:
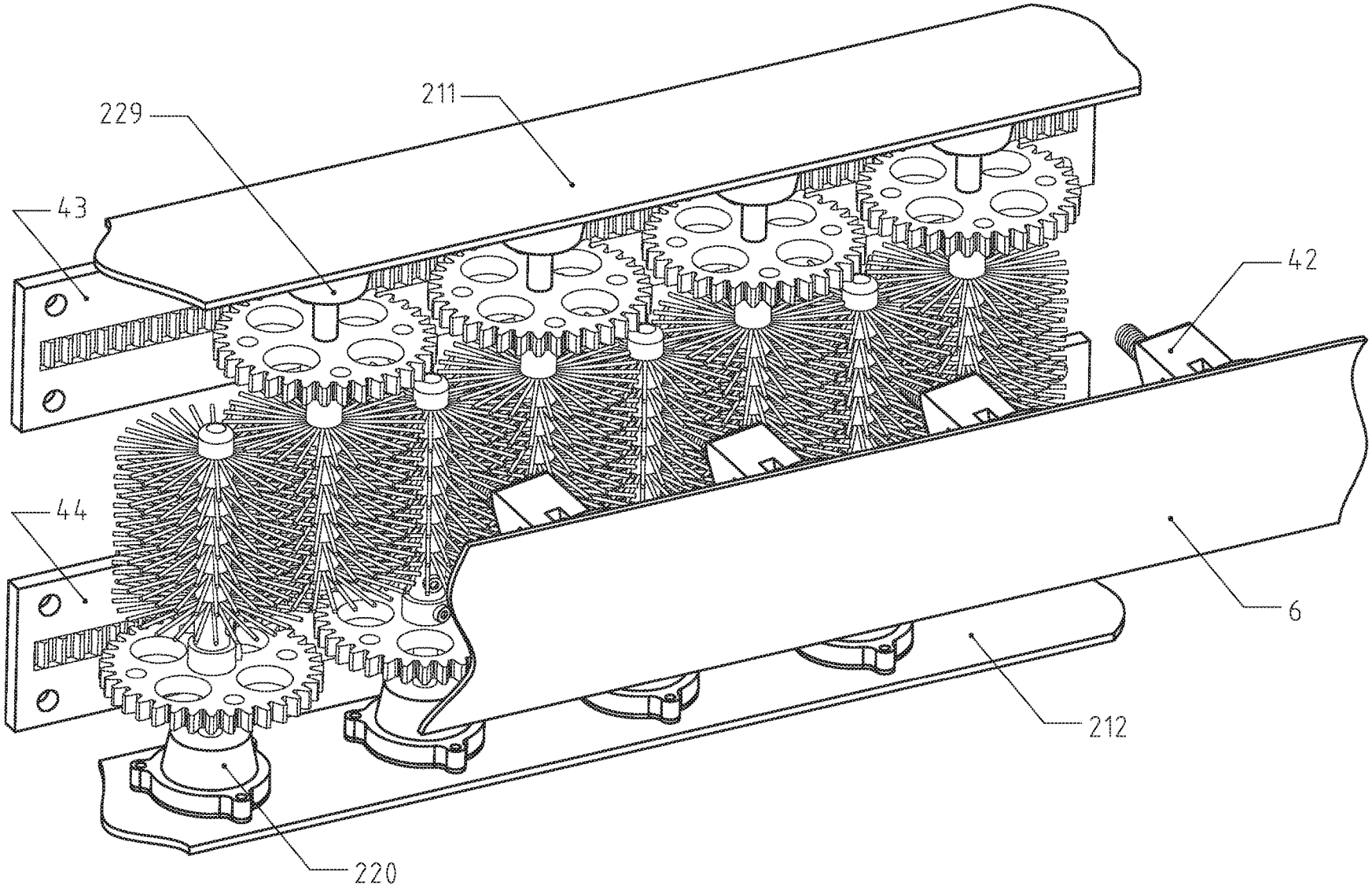
FIG. 6 is a partial structure 3d-drawing of a bolt grease removal device disclosed in embodiment two.
Figure 16:
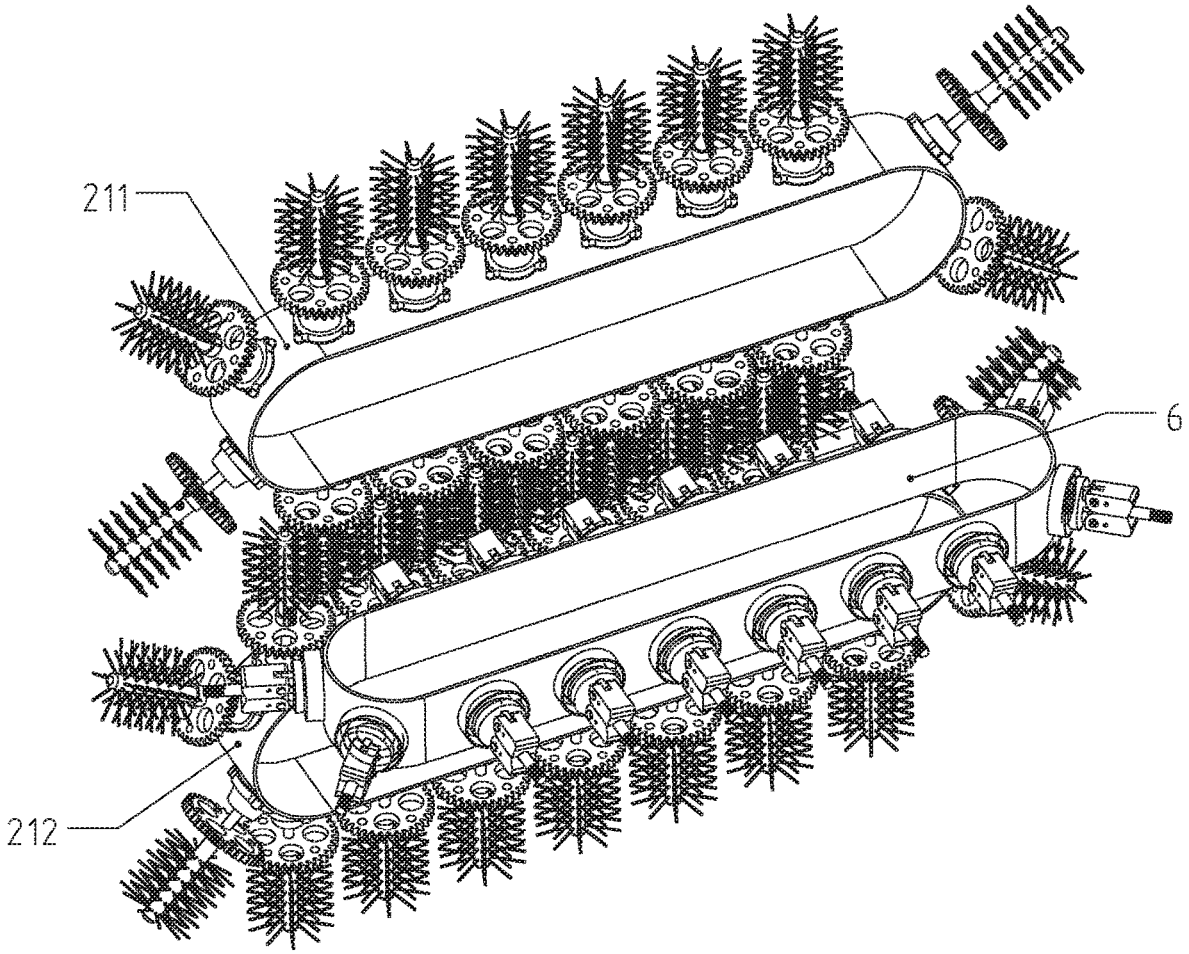
FIG. 16 is a partial structure 3d-drawing of a bolt grease removal device disclosed in embodiment two.

FIG. 6 and FIG. 16 show a main internal transmission structure of the bolt grease removal device disclosed in this embodiment. The main internal transmission structure comprises a first cleaning belt 211, a second cleaning belt 212, a conveyor belt 6, a second rack 43, and a third rack 44. Wherein the first cleaning belt 211 is driven by a first driven wheel 18, the second cleaning belt 212 is driven by a second driven wheel 20, the conveyor belt 6 is driven by a first electric motor 8, the second rack 43 is fixedly connected to the rectangular box 1, the third rack 44 is fixedly connected to the rectangular box 1, the second rack 43 is arranged along a moving direction of the first cleaning belt 211, the third rack 44 is arranged along a moving direction of the second cleaning belt 212.

The first cleaning belt 211 and the second cleaning belt 212 are arranged in parallel, the first cleaning belt 211 is provided with a first cleaning brush group 229, the first cleaning brush group 229 comprises a plurality of cleaning brushes 22 fixedly connected to the first cleaning belt 211, adjacent cleaning brushes 22 are separated by a certain distance. The second cleaning belt 212 is provided with a second cleaning brush group 220, the second cleaning brush group 220 comprises a plurality of cleaning brushes 22 fixedly connected to the second cleaning belt 212, adjacent cleaning brushes 22 are separated by a certain distance. The conveyor belt 6 is provided with a plurality of the clamping components 42 fixedly connected to the conveyor belt 6, the clamping component 42 clamps the bolt 0 so that the bolt 0 enters a cleaning area composed of the cleaning brushes 22 of the first cleaning brush group 229 and the second cleaning brush group 220 to remove grease. The cleaning brushes 22 of the first cleaning brush group 229 and the second cleaning brush group 220 are alternately arranged opposite to each other, brush rings 225 of adjacent cleaning brushes 22 are alternately arranged, the first cleaning brush group 229 cooperates with the second rack 43, the second cleaning brush group 220 cooperates with the third rack 44.

By alternately arranging the cleaning brushes 22 of the first cleaning brush group 229 and the cleaning brushes 22 of the second cleaning brush group 220 opposite to each other to increase number of cleaning brushes 22 per unit distance, when the bolt 0 passes through the cleaning area, it is beneficial to improve cleaning effect of outer surface of the bolt 0. Through an alternate arrangement of the first cleaning brush group 229 and the second cleaning brush group 220, the brush rings 225 of adjacent cleaning brushes 22 are also alternately arranged, so that outer surface of the bolt 0 is cleaned by the brush bars in different rotation directions, it is beneficial to improve a cleaning effect of outer surface of the bolt 0.

Figure 7:
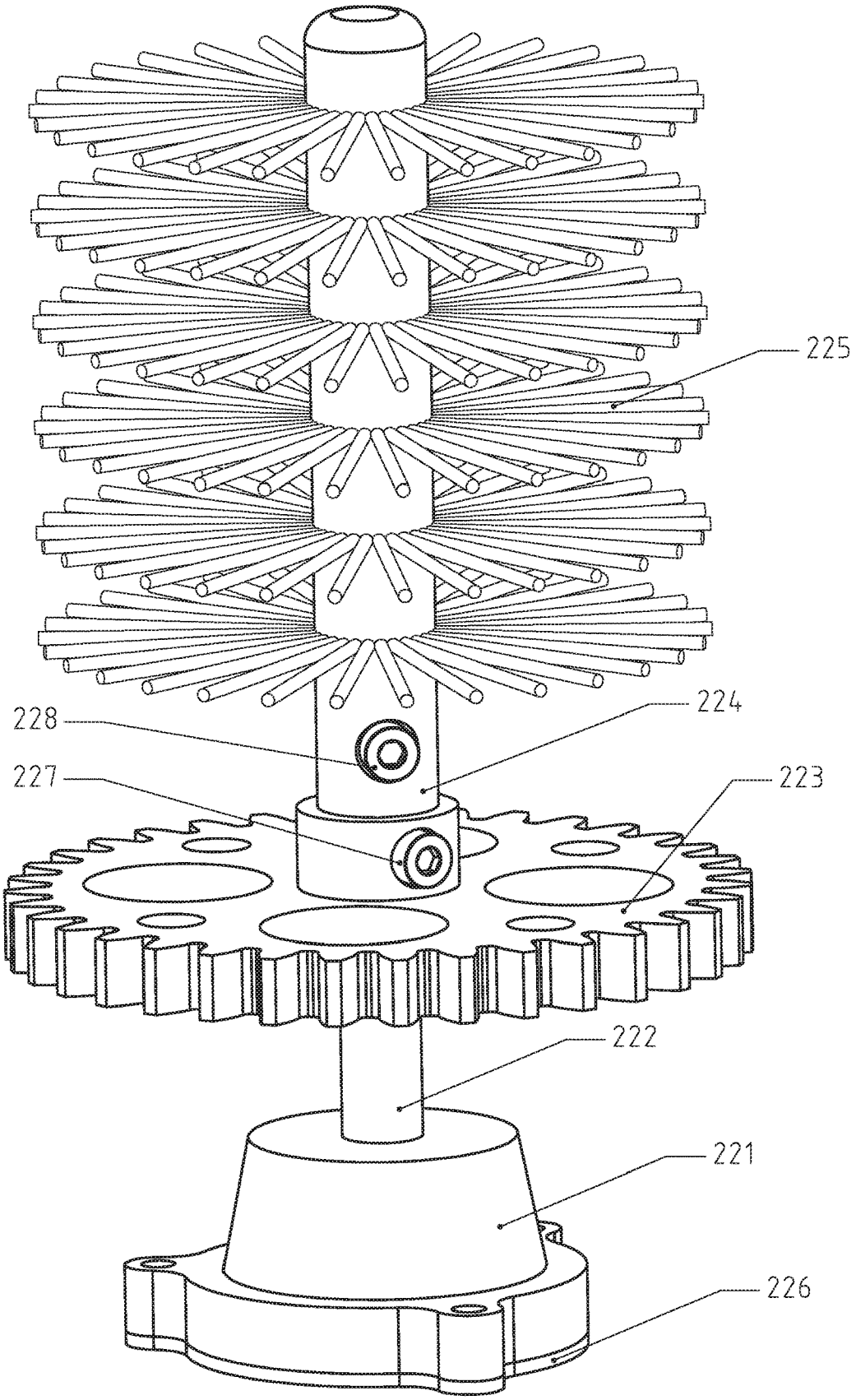
FIG. 7 is a 3d-drawing of a cleaning brush disclosed in embodiment two.

Referring to FIG. 7, the cleaning brush 22 disclosed in this embodiment comprises a fixing seat, a second rod 222, a second gear 223, and a third rod 224. The fixing seat is fixedly connected with the cleaning belt 211 or 212, the second rod 222 is coaxially connected with the fixing seat for rotation, the second gear 223 is coaxially fixedly connected with the second rod 222 and is detachably connected by a first screw 227, the second gear 223 is used for meshing transmission with the second rack 43 or the third rack 44, The third rod 224 is coaxially connected with the second rod 222 and is detachably connected by a second screw 228. The third rod 224 is coaxially provided with a plurality of brush rings 225 distributed along its axial direction, and adjacent brush rings 225 are separated by a certain distance. The brush ring 225 comprises a plurality of brush bars arranged radially outward of the third rod 224.

Figure 8:
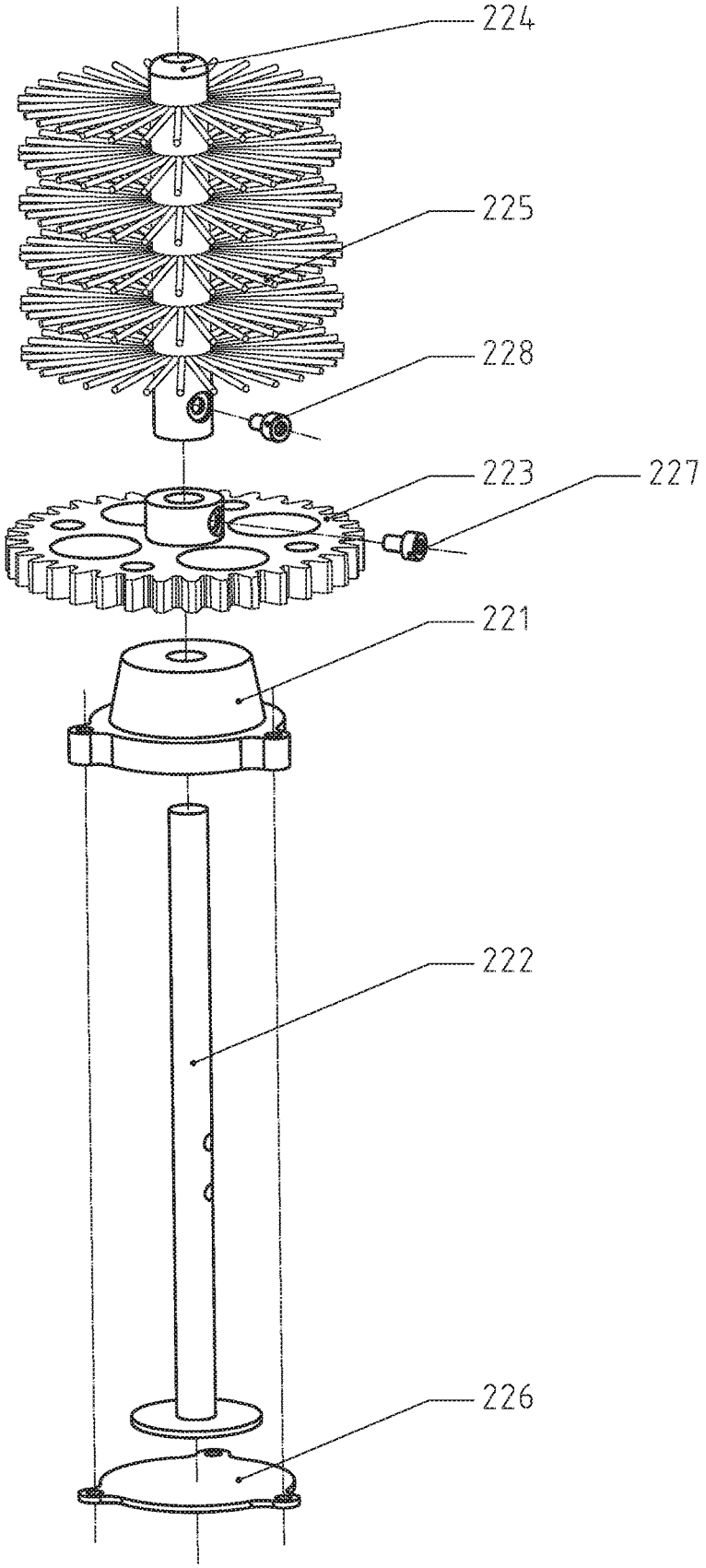
FIG. 8 is an exploded 3d-drawing of FIG. 7.

Since the second rod 222 and the third rod 224 of the cleaning brush 22 are detachably connected, only the third rod 224 needs to be replaced after brush bars of the cleaning brush 22 are worn out, the entire cleaning brush 22 does not need to be replaced. Since the second rod 222 and the second gear 223 are detachably connected, only the second gear 223 needs to be replaced after the second gear 223 is worn out, the entire cleaning brush 22 does not need to be replaced, as shown in FIG. 8

Figure 9:
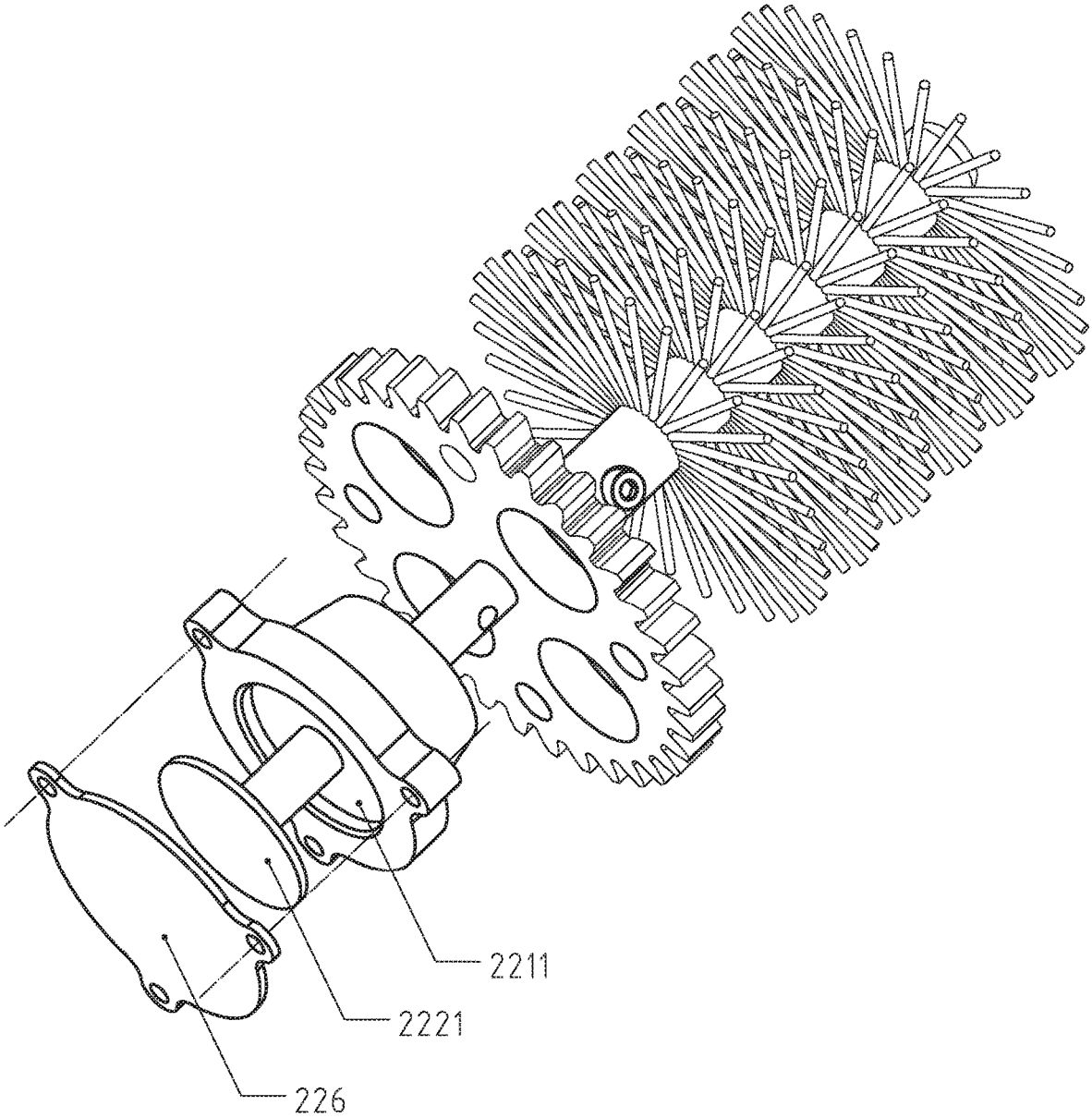
FIG. 9 is a partial exploded 3d-drawing of FIG. 7.

Referring to FIG. 9, the fixing seat comprises a second seat 221 and a bottom plate 226, the second seat 221 is coaxially provided with a pit 2211. An end of the second rod 222 is coaxially provided with a disc 2221, a diameter of the disc 2221 is greater than a diameter of an end of the second rod 222, the disc 2221 is accommodated in a space formed by the pit 2211 and the bottom plate 226 to restrict an axial movement of the second rod 222.

Figure 10:
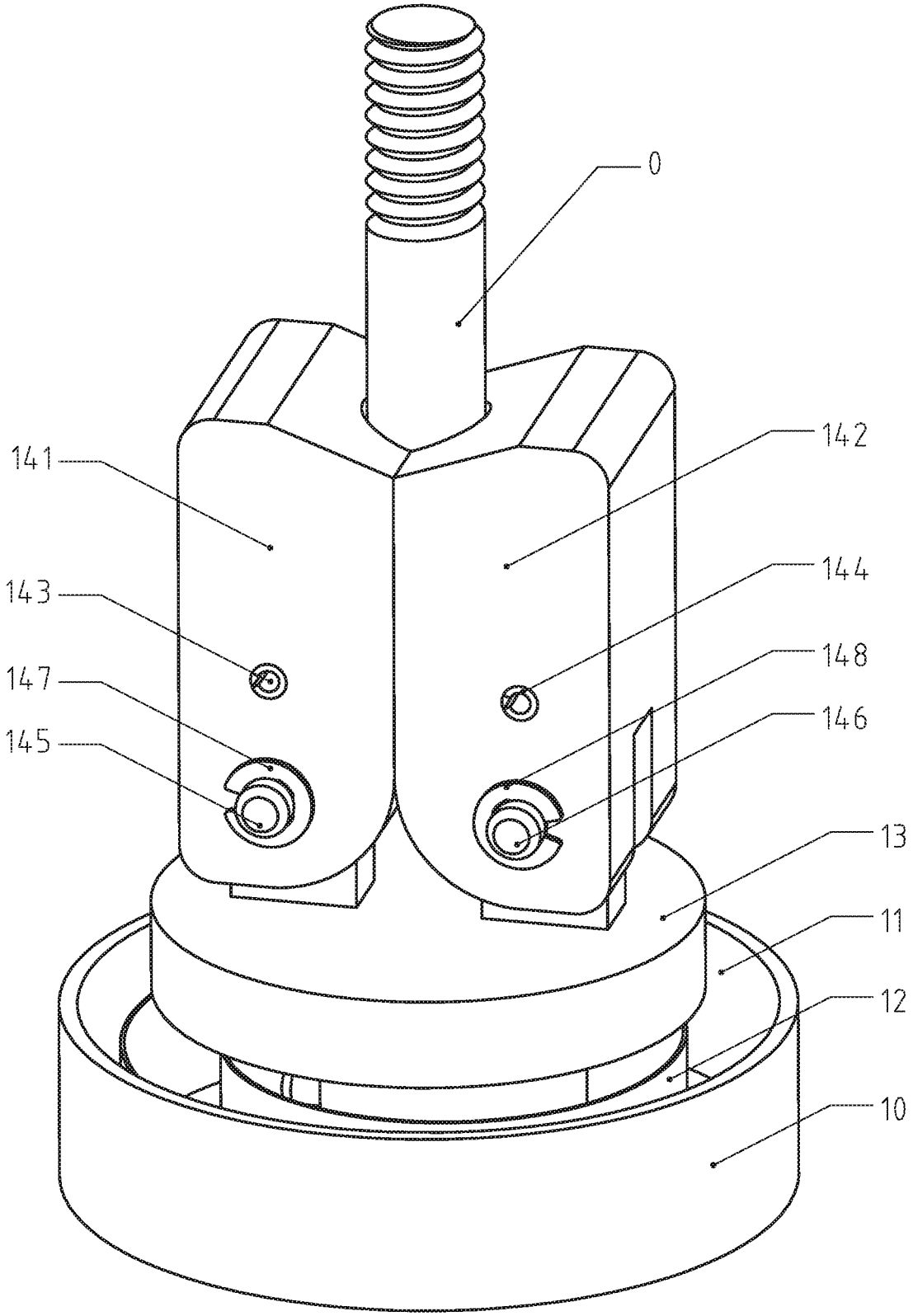
FIG. 10 is a 3d-drawing of a clamping component in a clamping state disclosed in embodiment two.

FIG. 10 shows the clamping component 42 disclosed in this embodiment, the clamping component 42 is in a clamping state and has clamped the bolt 0. The clamping component 42 comprises a installation box 10, a clockwork spring 12, a rotating disc 13, a first swing lever 141, a second swing lever 142, a first pin 143, a second pin 144, a third pin 145, a fourth pin 146, a first retaining ring 147, a second retaining ring 148 and an extension spring 15. Wherein the clockwork spring 12 is arranged between the installation box 10 and the rotating disc 13, an outer ring of the clockwork spring 12 is fixedly connected to the installation box 10, an inner ring of the clockwork spring 12 is fixedly connected to the rotating disc 13. The rotating disc 13 is coaxially connected to the installation box 10 for rotation, the rotating disc 13 realizes a rotational connection between the rotating disc 13 and the first swing lever 141 by cooperation of the third pin 145 and the first retaining ring 147. The rotating disc 13 realizes a rotational connection between the rotating disc 13 and the second swing lever 142 by cooperation of the fourth pin 146 and the second retaining ring 148. The extension spring 15 realizes a fixed connection between a first end of the extension spring 15 and the first swing lever 141 by the first pin 143, the extension spring 15 uses the second pin 144 to realize a fixed connection between a second end of the extension spring 15 and the second swing lever 142. The first pin 143 and the second pin 144 are elastic cylindrical pins, a fixed connection of the extension spring 15 is realized by an interference fit between the elastic cylindrical pin and the swing levers 141 and 142, as shown in FIG. 12.

Figure 14:
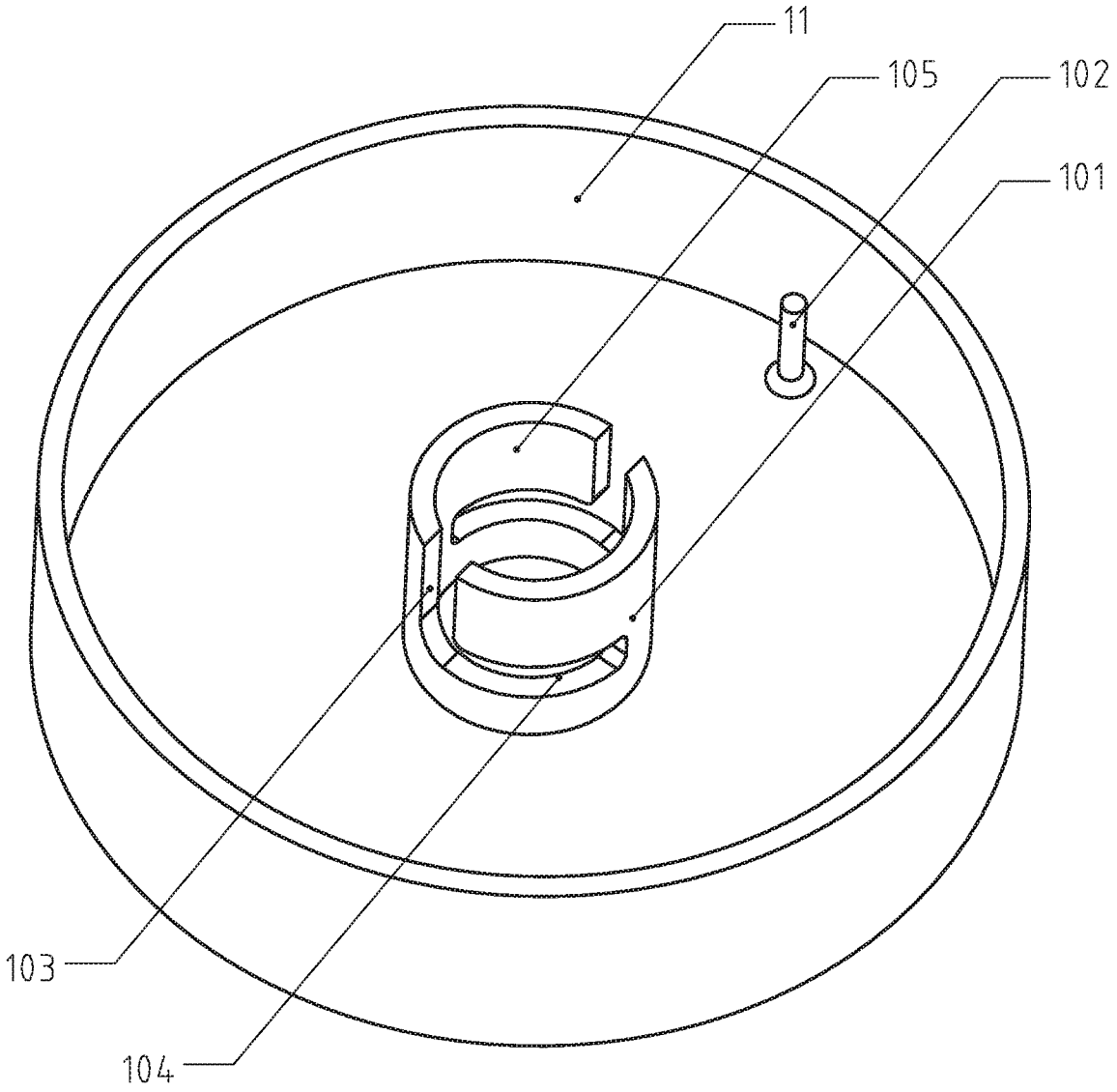
FIG. 14 is a 3d-drawing of an installation box disclosed in embodiment two.

Referring to FIG. 14, the installation box 10 is a columnar structure with a bottom and no cover, the installation box 10 comprises an end surface and a second cylindrical surface perpendicular to the end surface. A first seat 101 is vertically arranged on the end surface, and the first seat 101 is coaxial with the second cylindrical surface, the first seat 101 extends toward a second opening 11 side. The end surface is also vertically provided with a first rod 102 extending toward the second opening 11. The first seat 101 is separated from the first rod 102 by a certain distance, the first seat 101 is a columnar structure, and the first seat 101 is coaxially provided with a blind hole 105. A first cylindrical surface of the first seat 101 is provided with a first slideway 103 and a second slideway 104, the first slideway 103 is connected to the second slideway 104 and both are connected to the blind hole 105. The first slideway 103 is arranged along an axial direction of the first seat 101, the second slideway 104 is perpendicular to the first slideway 103. Wherein the second shaft 134 is an elastic cylindrical pin, a fixed connection between the second shaft 134 and the first shaft 133 is realized by an interference fit between the elastic cylindrical pin and the first shaft 133, the first arm 131 and the second arm 132 are symmetrically arranged. The first arm 131 realizes a rotational connection between the first arm 131 and the first swing lever 141 by cooperation of the third pin 145 and the first retaining ring 147, the second arm 132 realizes a rotational connection between the second arm 132 and the second swing lever 142 by cooperation of the fourth pin 146 and the second retaining ring 148.

Figure 11:
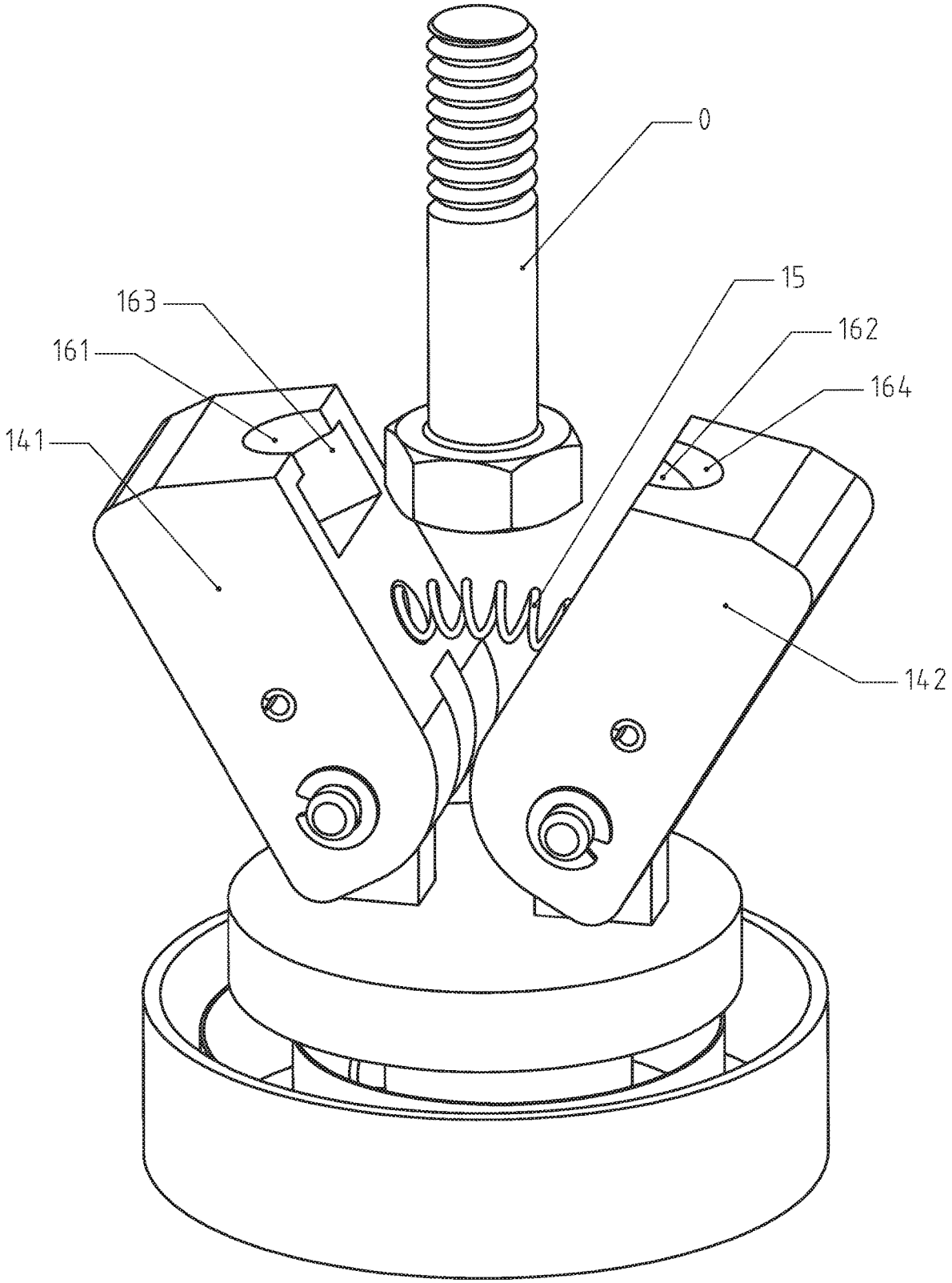
FIG. 11 is a 3d-drawing of a clamping component in an opening state disclosed in embodiment two.
Figure 12:
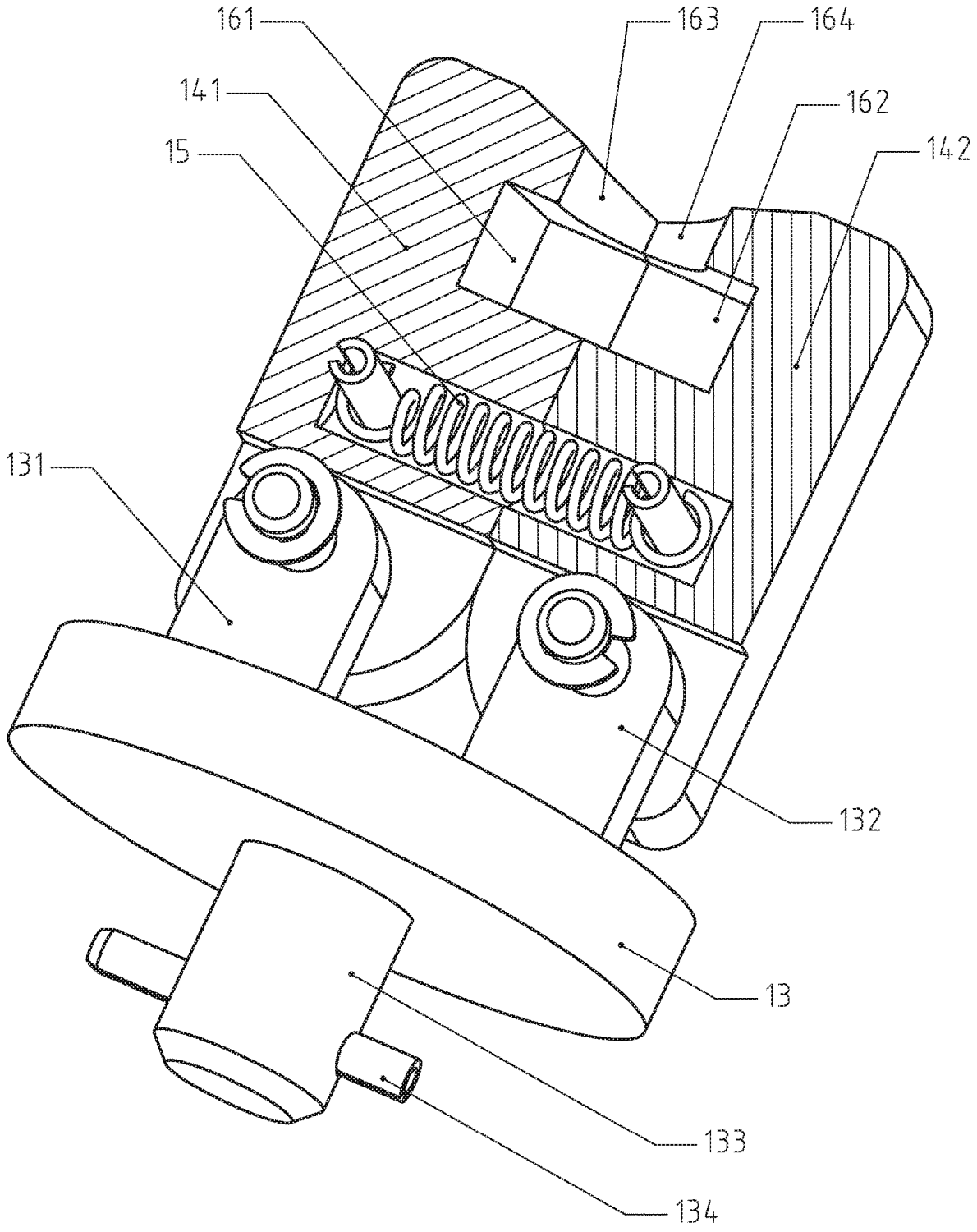
FIG. 12 is a partial sectional 3d-drawing of a clamping component disclosed in embodiment two.

Refer to FIGS. 11-12, the first swing lever 141 is provided with a first rectangular groove 161 for partially receiving a head portion of the bolt 0 and a first half hole 163 for partially receiving a shaft portion of the bolt 0, the first half hole 163 communicates with the first rectangular groove 161. An end of the first swing lever 141 is provided with a first inclined surface, when the head portion of the bolt 0 abuts the first inclined surface, the first swing lever 141 rotates and separates from the second swing lever 142. The second swing lever 142 is provided with a second rectangular groove 162 for partially receiving the head portion of the bolt 0 and a second half hole 164 for partially receiving the shaft portion of the bolt 0, the second half hole 164 communicates with the second rectangular groove 162. An end of the second swing lever 142 is provided with a second inclined surface, when the head portion of the bolt 0 abuts the second inclined surface, the second swing lever 142 rotates and separates from the first swing lever 141. A rectangular groove formed by the first rectangular groove 161 and the second rectangular groove 162 is used to receive the head portion of the bolt 0, a hole formed by the first half hole 163 and the second half hole 164 is used to receive the shaft portion of the bolt 0. When the head portion of the bolt 0 abuts the first inclined surface and the second inclined surface, the first swing lever 141 and the second swing lever 142 rotate and separate from each other. The first swing lever 141 and the second swing lever 142 rotate under the elastic force from the extension spring 15 and abut each other after the head portion of the bolt 0 enters a space formed by the first rectangular groove 161 and the second rectangular groove 162, the head portion of the bolt 0 is confined in the rectangular groove formed by the first rectangular groove 161 and the second rectangular groove 162, the rectangular groove limits a rotation and an axial movement of the head portion of the bolt 0. When the bolt 0 receives force from the cleaning brush 22 to make the bolt 0 rotate in a small range, the bolt 0 drives the clamping component 42 to rotate in a small range. The first half hole 163 of the first swing lever 141 and the second half hole 164 of the second swing lever 142 surround the shaft portion of the bolt 0 to increase stability of the bolt 0 during clamping.

Figure 13:
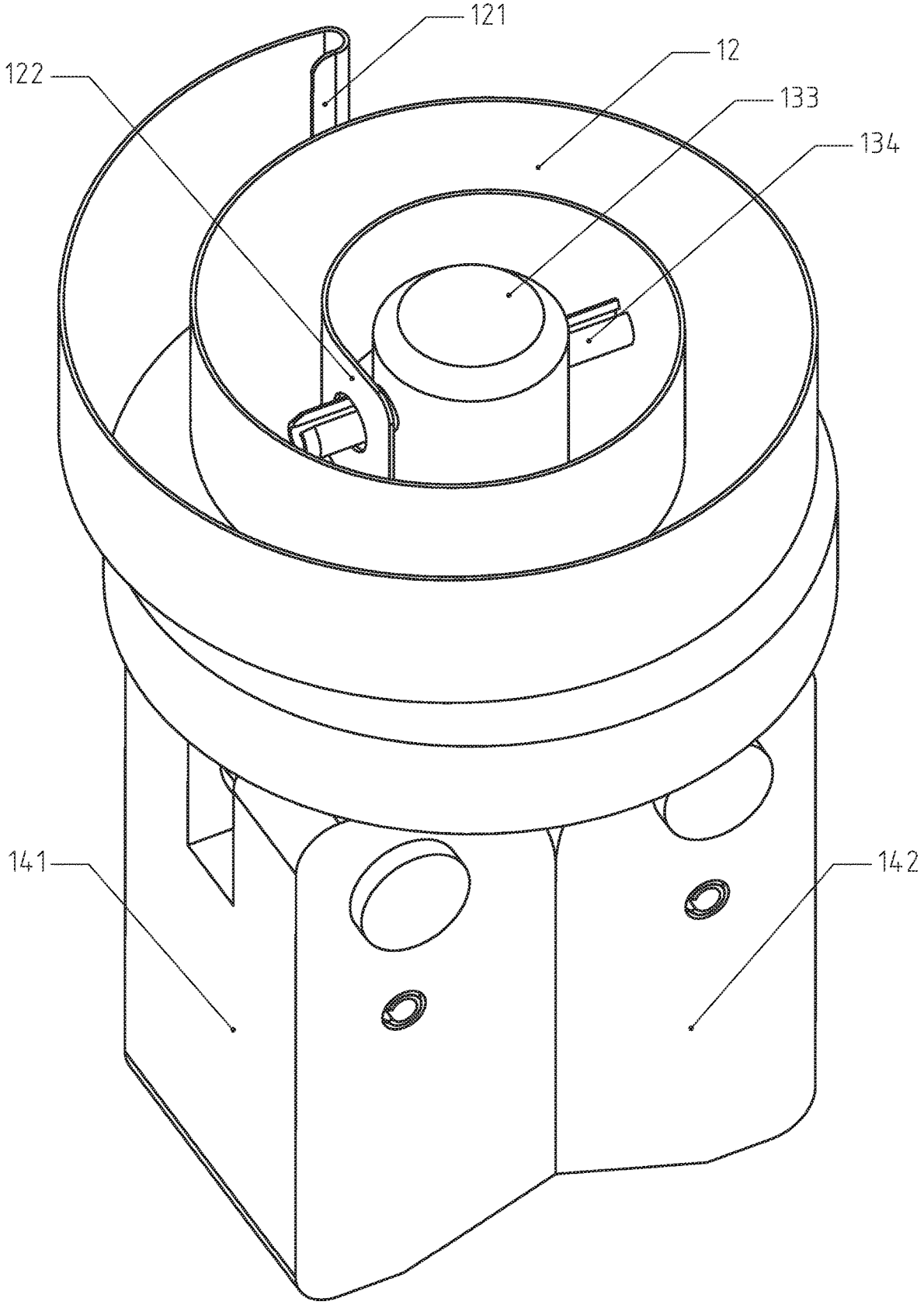
FIG. 13 is a 3d-drawing of a clamping component from another view disclosed in embodiment two, wherein an installation box is hidden.

Referring to FIG. 13, the clockwork spring 12 comprises a first end 121 arranged on an outer ring and a second end 122 arranged on an inner ring, the first end 121 has a hook-shaped structure, and the second end 122 is provided with a through hole.

Figure 15:
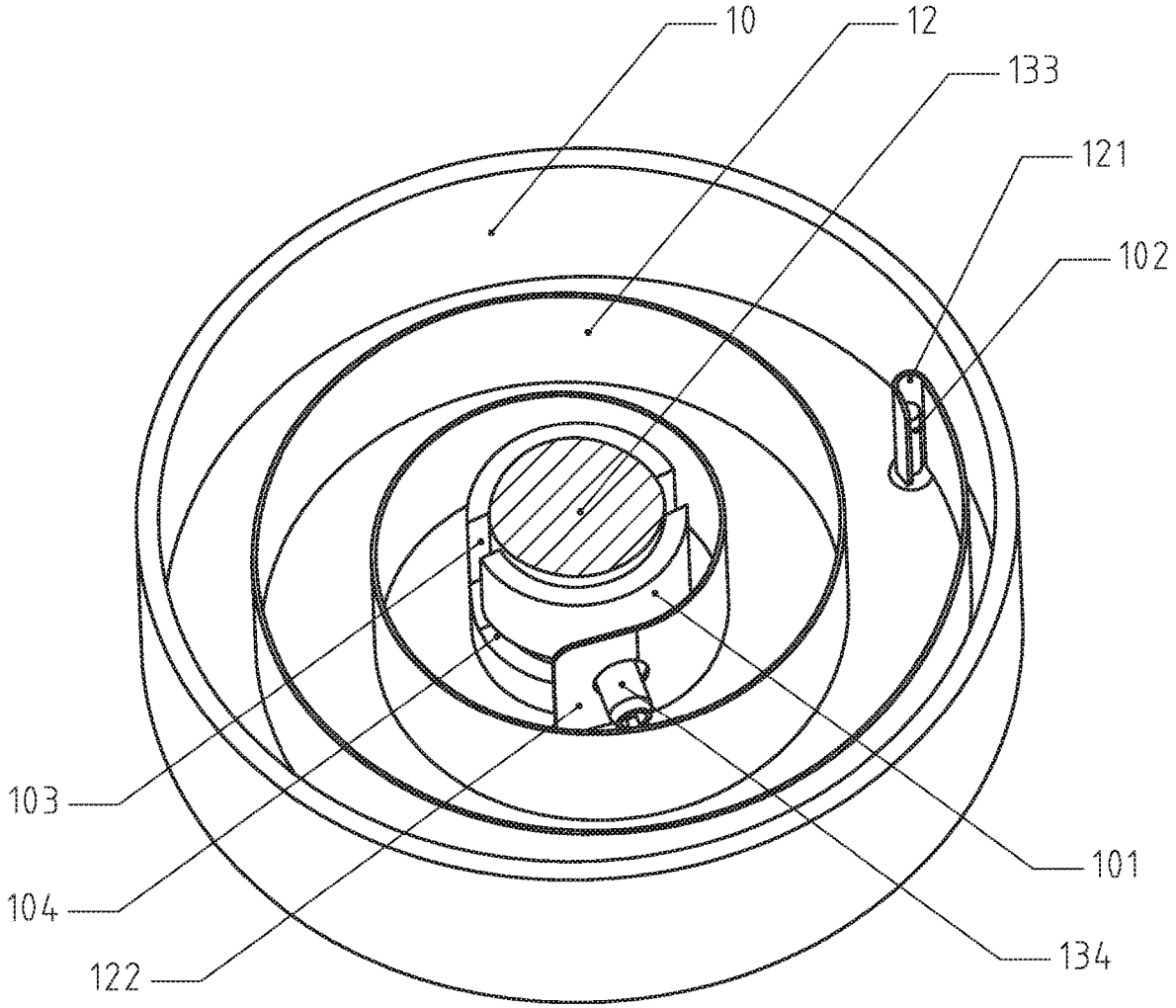
FIG. 15 is a partial sectional 3d-drawing of a clamping component disclosed in embodiment two.

Referring to FIG. 15, the hook-shaped structure of the first end 121 of the clockwork spring 12 is matched with the first rod 102 of the installation box 10, the through hole of the second end 122 of the clockwork spring 12 is matched with the second shaft 134 of the rotating disc 13. The first shaft 133 of the rotating disc 13 is rotatably engaged with the blind hole 105 provided in the first seat 101 of the installation box 10, the second shaft 134 of the rotating disc 13 is in sliding engagement with the first slideway 103 and the second slideway 104 provided on the first seat 101. First hook the first end 121 of the clockwork spring 12 to the first rod 102, then insert the second shaft 134 of the rotating disc 13 into the through hole of the second end 122 of the clockwork spring 12 and rotate the rotating disc 13 to rotate and pre-tension the clockwork spring 12, finally, insert the second shaft 134 of the rotating disc 13 into the first slideway 103, the second shaft 134 is pulled into the second slideway 104 and stays in the second slideway 104 under elastic force from the clockwork spring 12. A rotating connection between the installation box 10 and the rotating disc 13 is realized by an axial restriction effect of the second slideway 104 and the clockwork spring 12 is restricted between the installation box 10 and the rotating disc 13. When the bolt 0 receives force from the cleaning brush 22 to make the bolt 0 rotate slightly, the bolt 0 rotates back to its original position under elastic force from the clockwork spring 12, the bolt 0 has a certain degree of toughness during rotation of the bolt 0, thereby increasing an area of outer surface of the bolt 0 to be cleaned.

The invention claimed is:

1. A bolt grease removal device comprises a rectangular box (1), a roller driving unit and a controller (2) being arranged to a side surface of the rectangular box (1), wherein a grease removal unit comprising a first opening (23) provided on a side surface of the rectangular box (1) is arranged to an inner surface of the rectangular box (1), a grease collection unit being arranged to a lower end of an inner surface of the rectangular box (1), the grease removal unit comprising a T-shaped opening (3) arranged on a side surface of the rectangular box (1), two T-shaped openings (3) being arranged in a parallel state, upper and lower ends of the T-shaped opening (3) being provided with a first bearing (4), the first bearing (4) being fixedly connected with the rectangular box (1), an inner surface of the first bearing (4) being provided with a rotating roller (5), the rotating roller (5) being connected to the first bearing (4) by plug-in connection, a conveyor belt (6) being installed on an outer surface of the rotating roller (5), both ends of the conveyor belt (6) being sleeved with the rotating roller (5), a lower end of a side surface of the conveyor belt (6) being provided with a first rack (7), the first rack (7) being fixedly connected to the conveyor belt (6), a first electric motor (8) being installed on a side surface of the rectangular box (1), a first gear (9) that meshes with the first rack (7) being provided on a rotating end of the first electric motor (8);

an installation box (10) being installed on an outer surface of the conveyor belt (6), the installation box (10) being fixedly connected to the conveyor belt (6), a second opening (11) being arranged on one side of the installation box (10), a clockwork spring (12) being installed on an inner surface of the installation box (10), an outer ring of the clockwork spring (12) being fixedly connected with the installation box (10), an inner ring of the clockwork spring (12) being provided with a rotating disc (13), the rotating disc (13) being plugged in and connected with the clockwork spring (12), a side surface of the rotating disc (13) being provided with a swing lever (14), two swing levers (14) being provided, one end of each swing lever (14) being plug-in connected with the rotating disc (13), an extension spring (15) being installed between the swing levers (14), the extension spring (15) being fixedly connected to the swing levers (14), one end of each swing lever (14) being provided with a rectangular groove (16);

a first roller (17) being installed on an opposite side surface of an upper end of the rectangular box (1), the first roller (17) being connected to the rectangular box (1) by plug-in connection, a first driven wheel (18) being installed at one end of the first roller (17), a second roller (19) being installed on an opposite side surface of a lower end of the rectangular box (1), the second roller (19) being connected to the rectangular box (1) by plug-in connection, a second driven wheel (20) being installed at one end of the second roller (19), each outer surface of the first roller (17) and the second roller (19) being provided with a cleaning belt (21), both ends of the cleaning belt (21) being respectively sleeved with the first roller (17) and the second roller (19), a cleaning brush (22) being arranged on an outer surface of the cleaning belt (21), the cleaning brush (22) being fixedly connected with the cleaning belt (21).

2. The bolt grease removal device according to claim 1, wherein the first opening (23) being located under the cleaning belt (21), a sliding groove (24) being installed on one side of the first opening (23), the sliding groove (24) being fixedly connected with the rectangular box (1), an inner surface of the sliding groove (24) being provided with a collection box (25), the collection box (25) being slidably connected with the sliding groove (24), a rectangular baffle (26) being installed on an upper end of a side surface of the collection box (25), a lower end of the rectangular baffle (26) being fixedly connected with the collection box (25), a strip opening (27) being provided at an upper end of the rectangular baffle (26), the strip opening (27) corresponding to a position of the cleaning brush (22);

a cleaning liquid tank (28) being installed on a side surface of the rectangular box (1), the cleaning liquid tank (28) being fixedly connected with the rectangular box (1), a suction pump (29) being installed on a lower surface of the cleaning liquid tank (28), a high-pressure nozzle (30) being installed on the side surface of the rectangular box (1), a connecting pipe (31) being installed between the high-pressure nozzle (30) and the suction pump (29).

3. The bolt grease removal device according to claim 1, wherein the roller driving unit comprises a second electric motor (32) arranged on a side surface of the rectangular box (1), the second electric motor (32) being fixedly connected to the rectangular box (1), a pulley (33) being installed on a rotating end of the second electric motor (32), a first V-belt (34) being installed between the pulley (33) and the first driven wheel (18), a second V-belt (35) being installed between the pulley (33) and the second driven wheel (20).

4. The bolt grease removal device according to claim 1, wherein a squeeze roller (40) is installed on a side surface of the rectangular box (1), the squeeze roller (40) corresponding to a position of the first gear (9).

5. The bolt grease removal device according to claim 1, wherein an observation window (36) is installed on one side of the first opening (23).

6. The bolt grease removal device according to claim 1, wherein a non-slip base (37) is provided on a lower surface of the rectangular box (1), the non-slip base (37) being fixedly connected to the rectangular box (1).

7. The bolt grease removal device according to claim 1, wherein a rectangular handrail (38) is installed on a side surface of the rectangular box (1).

8. The bolt grease removal device according to claim 1, wherein a maintenance port (39) is arranged on a side surface of the rectangular box (1).

* * * * *